US005833575A

United States Patent [19]

Holslag

[11] Patent Number: 5,833,575

[45] Date of Patent: Nov. 10, 1998

[54] PORTABLE EXERCISE APPARATUS HAVING CHAIR MOUNTABLE SUPPORT BASE AND VARIABLE RESISTANCE EXERCISE ARMS

[76] Inventor: Nicholas J. C. Holslag, Renaissance Fitness, 4660 La Jolla Village Dr. Suite 1100, San Diego, Calif. 92122

[21] Appl. No.: 861,371

[22] Filed: May 27, 1997

[51] Int. Cl.[6] ..... A63B 22/00; A63B 21/015

[52] U.S. Cl. ..... 482/51; 482/57; 482/118; 482/904

[58] Field of Search ..... 482/51, 52, 53, 482/61, 57, 79, 80, 114, 115, 118, 119, 60

[56] References Cited

U.S. PATENT DOCUMENTS

| | | | |
|---|---|---|---|
| D. 158,675 | 5/1950 | Longfellow . | |
| 2,543,729 | 2/1951 | Magida | 482/118 |
| 2,921,791 | 1/1960 | Berne . | |
| 3,103,357 | 9/1963 | Berne | 482/118 |
| 3,525,522 | 8/1970 | Piller . | |
| 3,751,033 | 8/1973 | Rosenthal | 482/60 |
| 3,759,511 | 9/1973 | Zinkin | 482/51 |
| 3,968,963 | 7/1976 | Sileo . | |
| 4,222,376 | 9/1980 | Praprotnik | 482/60 X |
| 4,501,421 | 2/1985 | Kane et al. . | |
| 4,601,464 | 7/1986 | Mousel . | |
| 4,684,126 | 8/1987 | Dalebout et al. . | |
| 4,850,585 | 7/1989 | Dalebout . | |
| 5,000,443 | 3/1991 | Dalebout | 482/51 |
| 5,039,088 | 8/1991 | Shifferaw | 482/51 |
| 5,108,092 | 4/1992 | Hurst . | |
| 5,496,235 | 3/1996 | Stevens | 482/51 |
| 5,599,257 | 2/1997 | Lee | 482/51 |
| 5,647,822 | 7/1997 | Avganim | 482/57 X |
| 5,681,245 | 10/1997 | Lin | 482/51 |
| 5,707,320 | 1/1998 | Yu | 482/51 X |

*Primary Examiner*—Stephen R. Crow
*Assistant Examiner*—William LaMarca
*Attorney, Agent, or Firm*—Flanagan & Flanagan; John K. Flanagan; John R. Flanagan

[57] ABSTRACT

A portable exercise apparatus includes a support frame having a base mountable under a chair to hold the base in a stationary position with a user seated on the chair and an upright standard mounted upon the base, a shaft mounted to an upper end of the upright standard and having opposite ends extending from opposite sides thereof, a pair of arms disposed on opposite sides of the upright standard with each arm at one end mounted to one end of the shaft for rotatably mounting the arm to the upright standard, a pair of pedals each mounted to the other end of each of the arms for engagement by a user to create the force necessary to rotate the arms relative to the upright standard, and a resistance generating and adjusting mechanism disposed on the ends of the shaft at the opposite sides of the upright standard and engaged with the one ends of the arms and being operable to generate and selectively adjust a level of resistance to rotation of the pair of arms relative to the upright standard in response to rotation of the arms. The resistance generating and adjusting mechanism includes at least one conical-shaped spring washer received over one of the shaft ends and being respectively compressible and expandable for correspondingly increasing and decreasing the level of resistance to rotation of the arms by the user.

18 Claims, 2 Drawing Sheets

PORTABLE EXERCISE APPARATUS HAVING CHAIR MOUNTABLE SUPPORT BASE AND VARIABLE RESISTANCE EXERCISE ARMS

BACKGROUND OF THE INVENTION

1. Field of the Invention

The present invention generally relates to exercise devices and, more particularly, is concerned with a portable exercise apparatus having variable resistance exercise arms employable by a user while seated on a chair mounted upon a support base of the apparatus to prevent it from moving away from user.

2. Description of the Prior Art

Many occupations require a worker to sit at a desk or the like for an extended period of time. Discomfort may occur in those portions of the body which are held in a generally restricted position. Immobilization of certain portions of the body may result in blood circulatory difficulties and/or other problems. It is thus desirable to be able to periodically exercise these cramped body portions.

A variety of portable exercise devices have been proposed over the years enabling persons to do exercises while seated on a chair, lying on a sofa or bed, or standing beside the apparatus. Some of these exercise devices do not have their own user seats and thus allow operation by a user from an independent seat. Some examples of these prior art exercise devices are disclosed in U.S. Pat. No. Des. 158,675 to Longfellow, U.S. Pat. No. 2,921,791 to Berne, U.S. Pat. No. 3,525,522 to Piller, U.S. Pat. No. 3,751,033 to Rosenthal, U.S. Pat. No. 3,968,963 to Sileo, U.S. Pat. No. 4,501,421 to Kane et al., U.S. Pat. No. 4,601,464 to Mousel, U.S. Pat. No. 4,684,126 to Dalebout et al., U.S. Pat. No. 4,850,585 to Dalebout and U.S. Pat. No. 5,108,092 to Hurst.

Although these prior art exercise devices have different designs, they also have several features in common. For instance, most of these exercise devices include some type of tensioning mechanism to adjust the level of resistance to rotation of rotatable elements used by the user in an exercising activity. In one example, the Longfellow design patent appears to show a a rotary shaft with a pair of arms on the opposite ends thereof extending between a pair of clamps which have flanges mounting bolts with wing nuts and with coil springs between the flanges and wing nuts such that the tightening or loosening of the wing nuts will vary the force imposed by the coil springs on the rotary shaft. In another example, the Berne, Piller, Kane et al and Dalebout et al patents disclose friction discs or washers which provide the level of resistance between the relatively movable parts of the devices.

However, none of these prior art exercise devices appear to have the optimum combination of components to provide a portable exercise apparatus that would be an effective means to overcome the aforementioned problem created by sitting at a desk for an extended period of time. Consequently, a need still exists for an exercise device having a combination of components that will more readily and easily overcome the aforementioned problem.

SUMMARY OF THE INVENTION

The present invention provides a portable exercise apparatus designed to satisfy the aforementioned need. The portable exercise apparatus of the present invention is generally user-friendly, relatively compact and comfortable to use. The apparatus also takes up little space and is relatively inexpensive to build and yet is also durable.

Accordingly, the present invention is directed to a portable exercise apparatus which comprises: (a) a support frame having a base mountable under a chair to hold the base in a stationary position with a user seated on the chair, the support frame also having an upright standard mounted at a lower end upon the base and having an upper end spaced above the base; (b) an elongated shaft mounted to the upper end of the upright standard and having a pair of opposite end portions extending from opposite sides of the upright standard; (c) a pair of elongated arms each having a pair of opposite ends and being disposed on opposite sides of the upright standard, each of the arms at a first of the opposite ends being mounted to one of the opposite end portions of the shaft for rotatably mounting each arm to the upright standard; (d) a pair of members in the form of pedals each mounted to a second of the opposite ends of each of the arms for engagement by a user to create a force necessary to rotate the arms relative to the upright standard; and (e) a resistance generating and adjusting mechanism disposed on the opposite end portions of the shaft at the opposite sides of the upright standard and engaged with the first of the opposite ends of the arms and being operable to generate and selectively adjust a level of resistance to rotation of the arms relative to the upright standard in response to the rotation of the arms.

The resistance generating and adjusting mechanism includes a pair of first friction discs, a pair of second friction discs, at least one spring element and an adjustment knob. Each of the first friction discs has opposite first and second sides and is mounted to a respective one of the opposite end portions of the shaft such that the first sides of the first friction discs contact opposite sides of the upright standard in planes substantially parallel to the opposite sides of the upright standard and the second sides of the pair of first friction discs contact the first ends of the arms. Each of the second friction discs has opposite first and second sides and is mounted to a respective one of the opposite end portions of the shaft such that the first sides of the pair of second friction discs contact the first ends of the arms on sides thereof opposite from the first friction discs and the second side of one of the second friction discs contacts an enlarged element on the shaft. The spring element in the form of at least one annular conical-shaped washer receives one of the opposite end portions of the shaft therethrough and contacts the second side of the other of the pair of second friction discs. The spring element is compressible for increasing the level of resistance to rotation of the rotatable arms and is expandable for decreasing the level of resistance to rotation of the rotatable arms. The adjustable knob has a hole defined therein and receives an end of the shaft therein. The adjustable knob contacts the spring element and is rotatable in one direction relative to the shaft for causing compression of the spring element and is rotatable in an opposite direction relative to the shaft for allowing expansion of the spring element.

The resistance generating and adjusting mechanism also includes an anti-rotation pin assembly having a mounting bracket and a pin. The mounting bracket is attached to the upper end of the upright standard on an edge thereof extending between the opposite sides of the upright standard. The mounting bracket defines a slot extending between opposite lateral sides of the mounting bracket and opposite sides of the upright standard. The second friction discs have respective holes defined therethrough and alignable with one another and with the slot of the mounting bracket. The pin is inserted through the aligned holes of the second friction discs and the annular slot of the mounting bracket so as to prevent rotational movement of the second friction discs relative to the arms.

The support frame also includes a pair of generally U-shaped balancing members mounted in back-to-back facing relationship to one another upon the base. The lower end of the upright standard is disposed between and connected to the U-shaped balancing members. The base is in the form of a flat plate disposed below and mounted to the balancing members and extending outwardly in one direction from the upright standard for receiving the chair thereon and together with the U-shaped balancing members providing a means for capturing the chair so as to hold the chair in place to prevent backward movement thereof during use of the apparatus. The flat base plate may also receive the feet of the user when the hands of the user are being used to create force upon the pedals to cause rotation of the arms during use of the apparatus.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
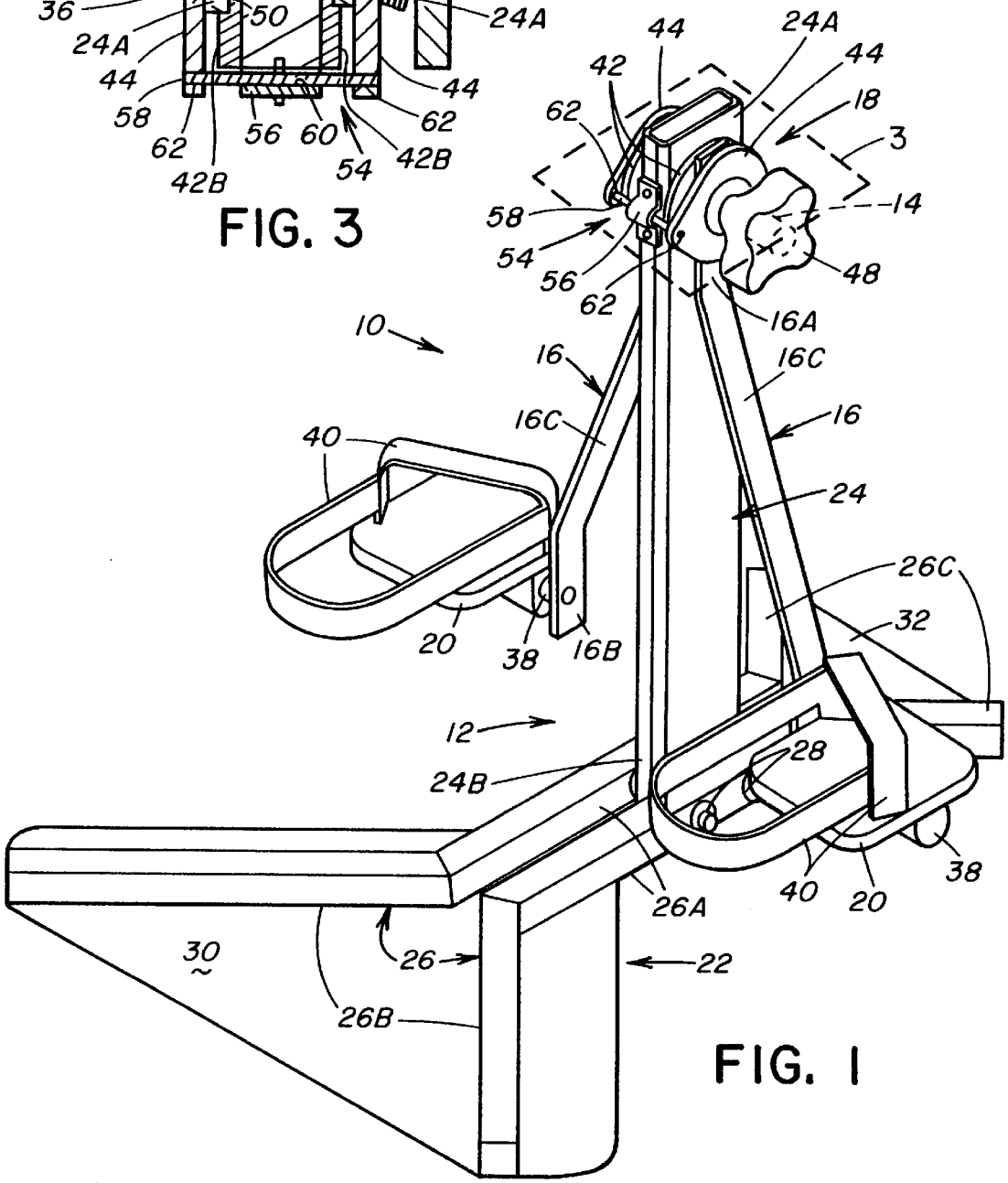
FIG. 1 is a right perspective view of a portable exercise apparatus of the present invention.
Figure 2:
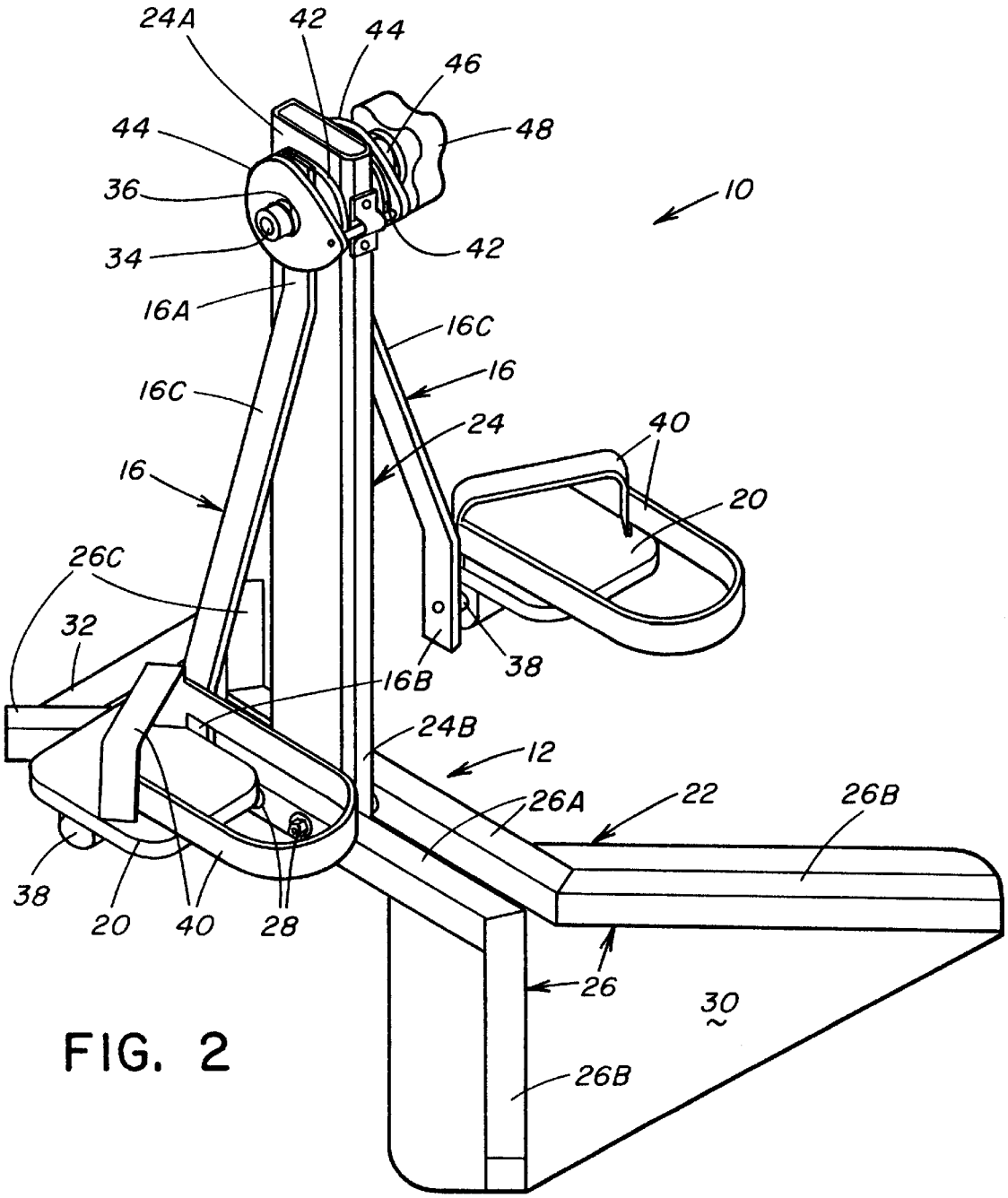
FIG. 2 is a left perspective view of the apparatus.

Referring to the drawings and particularly to FIGS. 1 and 2, there is illustrated a portable exercise apparatus, generally designated 10, of the present invention. The portable exercise apparatus 10 basically includes a support frame 12, an elongated shaft 14 mounted to the support frame 12, a pair of elongated arms 16 mounted to the shaft 14 for rotatably mounting each arm to the support frame 12, and a resistance generating and adjusting mechanism 18 mounted to the shaft 14 and operable to generate and selectively adjust a level of resistance to rotation of the arms 16 relative to the support frame 12 in response to rotation of the arms 16. The apparatus also includes a pair of members such as in the form of pedals 20 each mounted to one of the arms 16. The support frame 12 is attachable to a desk chair or the like.

Referring to FIGS. 1 and 2, the support frame 12 of the apparatus 10 includes a horizontal base 22 and an upright standard 24 having opposite upper and lower ends 24A, 24B. The support frame 12 can be secured to a chair or the like by the base 22 being mountable under the chair so that the chair will sit on top of the base 22 and holds the base in a stationary position with a user seated on the chair. More particularly, in an exemplary embodiment of the apparatus 10, the base 22 includes a pair of balancing members 26 mounted in a back-to-back facing relationship to one another. Each of the balancing members 26 has a substantially identical generally U-shaped configuration, although they can equally have other configurations as well. Each balancing member 26 has a straight middle portion 26A and opposite end portions 26B, 26C attached to and extending in opposite directions from the middle portion 26A. One opposite end portion 26B of each balancing member 26 is greater in length than the other opposite end portion 26C. The balancing members 26 lie in a common plane so as to distribute the weight of and thereby stabilize the apparatus 10 on a support surface, such as the floor of a facility.

The upright standard 24 of the support frame 12 preferably although not necessarily takes the form of an elongated rectangular-shaped bar fixedly mounted at the lower end 24B upon the base 22 so as to extend upwardly therefrom to the upper end 24A spaced above the base 12. The lower end 24B of the upright standard 24 is disposed between and connected to the middle portions 26A of the balancing members 26 by bolts 28 receiving through respective openings (not seen) in the lower end 24B of the upright standard 24 and the middle portions 26A of the balancing members 26 which fixedly supports the upright standard 24 in the vertical position relative to the base 22.

The base 22 of the support frame 12 also includes a base plate 30 disposed below and mounted to the undersides of the one opposite end portions 26B and middle portions 26A of the balancing members 26. The base plate 30 extends outwardly in one direction from the upright standard 24. The base plate 30 is shown substantially flat in shape, but can have any other suitable configuration. The base plate 30 receives the legs of the chair thereon and together with the balancing members 26 provide a means for blocking or capturing the legs of the chair so as to hold the chair in place to prevent its backward movement during use of the apparatus 10. The base plate 30 may also receive the feet of the user when the hands of the user are being used to create the necessary force upon the arms 16 to rotate the same. Also, a handle 32 can be attached across the other opposite end portions 26C of the balancing members 26.

Figure 3:
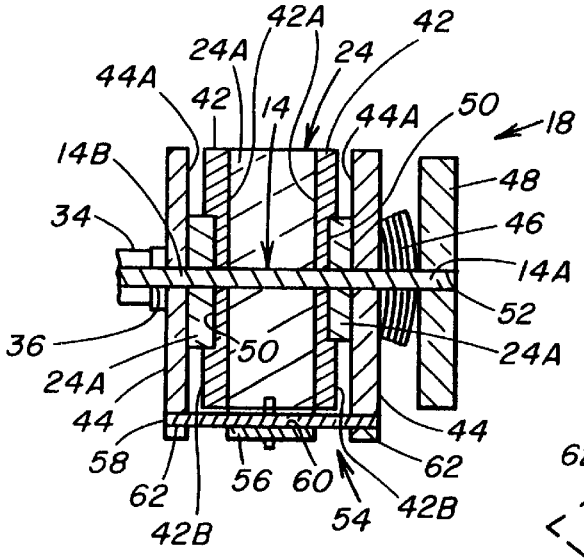
FIG. 3 is an enlarged horizontal sectional view of the apparatus as seen along plane 3 of FIG. 1 which bisects an elongated shaft of the apparatus.

As best seen in FIG. 3, the shaft 14 of the apparatus 10 which is substantially cylindrical in shape is slidably mounted through a passageway 24C in the upper end 24A of the upright standard 24. The shaft 14 preferably has a diameter only enough smaller than that of the passageway 24C for slidably fitting through the passageway 24C but in a relatively snug or close fitting relationship with the upright standard 24. The shaft 14 has a pair of opposite end portions 14A, 14B extending in opposite directions outwardly from opposite sides of the upright standard 24. The shaft 14 also has an enlarged end element 34 on the left opposite end portion 14A, as viewed in FIG. 3, which may be integrally formed with rest of the shaft 14 but preferably takes the form of a screw cap 34 threaded thereon the left end portion 14B of the shaft 16. The enlarged end element 34 will prevent removal of the shaft 14 from the passageway 24C in one direction, thereby permitting removal of the shaft 14 from the passageway 24C only in the opposite direction and functions as part of the resistance generating and adjusting mechanism 18 described in detail below. Also, a lock washer 36 may be positioned on the left end portion 14B of the shaft 14 adjacent to the screw cap 34.

Referring again to FIGS. 1 and 2, each of the rotatable arms 16 of the apparatus 10 has first and second opposite ends 16A, 16B and a hole 16C defined through the first end 16A. The hole 16C in the arm 16 allows the arms at its first end 16A to be received over a respective one of the opposite end portions 14A, 14B of the shaft 14 and thereby disposed the arms 16 on opposite sides of the upright standard 24 of the support frame 12 and mount the arms 16 relative to the upright standard 24 via the shaft 14 such that the arms 16 can undergo rotation about the shaft 14 in opposite directions in substantially parallel relation to the upright standard 24 of the support frame 12. Each rotatable arm 16 can be substantially rectangular in shape in cross-section and substantially narrow and flat in shape along its length, but can also have any other suitable configuration. Each arm 16 further has a middle portion 16C which is disposed in an angled relationship with and rigidly attached to the opposite ends 16A, 16C of the arm 16 such that the opposite ends 16A, 16B are disposed in an offset but generally parallel relationship to one another and to the upright standard 24. The angled middle portion 16C forms an acute angle with the upright standard 24 of the support frame 12. Further, the angled middle portion 16C has a substantially greater length than each of the opposite ends 16A, 16B. The pedals 20 are rotatably mounted on respective rods 38 attached to and extending outwardly in opposite directions with respect to one another from the second ends 16B of the rotatable arms 16. The pedals 20 are adapted to receive the feet of the user for creating the force necessary to rotate the rotatable arms 16. Each pedal 20 is substantially flat in shape, but can have other suitable configurations, and has a strap 40 for securing a foot of the user on the pedal 20. Each pedal 20 is also suitable or can be adapted for receiving a hand rather than a foot of the user.

Referring to FIGS. 1 to 3, the resistance generating and adjusting mechanism 18 of the apparatus 10 includes a pair of first friction discs 42, a pair of second friction discs 44, at least one and preferably a plurality of spring elements 46, and an adjustable knob 48. Each of the first friction discs 42 of the mechanism 18 has opposite first and second sides 42A, 42B and is mounted to a respective one of the opposite end portions 14A, 14B of the shaft 14 such that the first sides 42A of the first friction discs 42 contact the upper end 24A of the upright standard 24 at the opposite sides thereof and are disposed in substantially parallel relationship thereto, whereas the second sides 42B of the first friction discs 42 contact the first ends 16A of the rotatable arms 16. More particularly, each of the second sides 42B of the first friction discs 42 has a recess 50 formed therein having a configuration complementary to that of a section of the first end 16A of the adjacent one of the arms 16 for receiving the first end 16A of the arm 16 therein so as to prevent its rotation relative to the respective first friction disc 42. Thus, each first friction disc 42 is preferably rotatable on a respective one of the opposite end portions 14A, 14B of the shaft 14, moving with the adjacently positioned one of the arms 16.

Each of the second friction discs 44 of the mechanism 18 has opposite first and second sides 44A, 44B and is mounted to a respective one of the opposite end portions 14A, 14B of the shaft 14 such that the first sides 44A of the second friction discs 44 contact the first ends 16A of the rotatable arms 16 on sides thereof opposite from the first friction discs 42 and the second side 44B of one of the second friction plates 44 contacts the enlarged end element 34 of the shaft 14. Whereas each of the first friction discs 42 rotate on the shaft 14, it is preferred that each of the second friction discs 44 be fixed or stationary relative to the shaft 14. Also, each of the first and second friction discs 42, 44 are substantially annular and flat in shape, but can have any other suitable configuration. Also, whereas the arms 16 are made of a suitable rigid material, such as a metal or plastic, the first and second friction discs 42, 44 are preferably made of a material that is more pliable than the material of the arms 16. The discs 42, 44 (and not the arms 16) are preferably the elements that will incur any wear and are readily replaceable after extended use.

Each of the spring elements 46 of the mechanism 18 preferably, although not necessarily, take the form of a conical-shaped spring washer, commonly referred to as a belleville washer, made of resilient material. The spring elements 46 are received over the right end portion 14A of the shaft 14 and make contact with the second side 44B of the other of the second friction discs 44. The spring elements are deformable or compressible from a normal conical shape to a more flattened shape upon application of an axially directed force thereto. The compression of the spring elements 46 toward a more flattened shape increases the level of friction created between the first friction discs 42 and the upright standard 24 and between the second friction discs 44 and the upper ends 16A of the arms 16 and thereby the level of resistance of the mechanism 18 to rotation of the arms 16 in response to rotation of the arms 16. The relieving of the compression of the spring elements 46 allows expansion of the spring elements 46 back to their more conical shape and decreases the level of friction and thereby the level of resistance to rotation of the arms 16 in response to rotation of the arms 16. The spring elements 46 are comprised of a suitable springy metal such as spring steel.

The adjustable knob 48 of the mechanism 18 has a threaded bore 52 defined therein permitting the threading of the knob 48 on the right end portion 14A of the shaft 14. The adjustable knob 48 will engage the spring elements 46 and upon rotation in one direction will cause compression of the spring elements 46 whereas upon rotation in an opposite direction will allow expansion of the spring elements 46. The adjustable knob 48 preferably has a knurled periphery which enhances gripping and turning the knob 48 by using only the fingers and/or thumb of a hand of a user. The knob 48 can have any other suitable configuration.

The resistance generating and adjusting mechanism 18 may further includes the screw cap 34 and lock washer 36. The lock washer 58 is received over the left end portion 14B of the shaft 14 and contacts the second side 44B of the other of the second friction discs 44 which does not contact the spring elements 46. The screw cap 34 is provided for tightening onto the shaft 14 and contacting the lock washer 36. The lock washer 36 and screw cap 34 are substantially annular in shape, but can have any other suitable configuration.

As still seen in FIGS. 1 to 3, the resistance generating and adjusting mechanism 18 of the apparatus 10 also preferably includes an anti-rotation pin assembly 54 which comprises a mounting bracket 56 and a pin 58. The mounting bracket 56 is attached to the upper end 24A of the upright standard 24 of the support frame 12 on a edge thereof extending between the opposite sides of the upright standard 24. The mounting bracket 56 defines a slot 60 extending between the opposite sides of the upright standard 24. The second friction discs 44 have respective holes 62 defined through their peripheral edges which are alignable with one another and with the slot 60 of the mounting bracket 56. The pin 58 is inserted through the aligned holes 62 of the second friction discs 44 and the slot 60 of the mounting bracket 56 so as to prevent rotational movement of the second friction discs 44 relative to the arms 16 in response to rotation of the arms 16.

In view of the foregoing description, it can be readily understood that the portable exercise apparatus 10 of the present invention is generally user-friendly, relatively compact in size and comfortable to use while seated in a conventional desk chair or the like. The user merely places his or her feet on the pedals 20 and turns the knob 48 to select the desired level of resistance and then pivots the arms 16 in a back and forth manner.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A portable exercise apparatus, comprising:

(a) a support frame having a base mountable upon a support surface under a chair to hold said base in a stationary position with a user seated on the chair, said support frame also having an upright standard mounted at a lower end upon said base and having an upper end spaced above said base, said support frame further having a pair of balancing members mounted upon said base and protruding above said base for engagement of the chair, said lower end of said upright standard being disposed between said balancing members, said base being disposed below and mounted to undersides of said balancing members and extending outwardly in one direction from said upright standard for receiving thereon the chair and together with said balancing members providing a means for capturing the chair so as to hold the chair in place to prevent backward movement thereof during use of the apparatus;

(b) an elongated shaft mounted to said upper end of said upright standard and having a pair of opposite end portions extending from opposite sides of said upright standard;

(c) a pair of elongated arms each having a pair of opposite ends and being disposed on opposite sides of said upright standard, each of said arms at a first of said opposite ends thereof mounted to one of said opposite end portions of said shaft for rotatably mounting each arm to said upright standard;

(d) a pair of members each mounted to a second of said opposite ends of a respective one of said arms for engagement by a user to create a force necessary to rotate said arms relative to said upright standard; and (e) a resistance generating and adjusting mechanism disposed on said opposite end portions of said shaft at said opposite sides of said upright standard and engaged with said first of said opposite ends of said arms and being operable to generate and selectively adjust a level of resistance to rotation of said arms relative to said upright standard in response to rotation of said arms.

2. The apparatus of claim 1 wherein said resistance generating and adjusting mechanism includes a pair of first friction discs, each of said first friction discs having opposite first and second sides and being mounted to a respective one of said opposite end portions of said shaft such that said first sides of said first friction discs contact said opposite sides of aid upright standard and said second sides of said first friction discs contact said first ends of said arms.

3. The apparatus of claim 2 wherein said second sides of said first friction discs have recesses formed therein receiving said first ends of said arms so as to prevent rotation of said arms relative to said first friction discs.

4. The apparatus of claim 2 wherein said resistance generating and adjusting mechanism further includes a pair of second friction discs, each of said second friction discs having opposite first and second sides and being mounted to a respective one of said opposite end portions of said shaft such that said first sides of said second friction discs contact said first ends of said arms on sides thereof opposite from said first friction discs and said second side of one of said second friction discs contacts said enlarged end element on said shaft.

5. The apparatus of claim 4 wherein said arms are made of a first material and said first and second friction discs are made of a second material more pliable than said first material of said arms so as to minimize wear on said arms.

6. The apparatus of claim 4 wherein said resistance generating and adjusting mechanism further includes a spring element mounted to one of said opposite end portions of said shaft and contacting said second side of said other of said second friction discs, said spring element being compressible for increasing the level of resistance to rotation of said arms and being expandable for decreasing the resistance to rotation of said arms.

7. The apparatus of claim 6 wherein said spring element includes at least one annular conical-shaped washer made of resilient material and deformable from a normal conical shape to a more flattened shape upon application of an axially directed force thereto, said washer being received over said one of said opposite end portions of said shaft.

8. The apparatus of claim 6 wherein said resistance generating and adjusting mechanism further includes a knob rotatably mounted on an end of said shaft and contacting said spring element, said knob being rotatable in one direction relative to said shaft for causing compression of said spring element and being rotatable in an opposite direction relative to said shaft for allowing expansion of said spring element.

9. The apparatus of claim 4 wherein said resistance generating and adjusting mechanism also includes an anti-rotation pin assembly comprising:

a mounting bracket attached to said upper end of said upright standard on an edge thereof extending between said opposite sides thereof, said mounting bracket defining a slot extending between said opposite sides of said upright standard, said second friction discs having respective holes defined therethrough and alignable with one another and with said slot of said mounting bracket; and a pin inserted through said aligned holes of said second friction discs and said slot of said mounting bracket so as to prevent rotational movement of said second friction discs relative to said arms.

10. The apparatus of claim 1 wherein said balancing members are generally U-shaped and mounted in back-to-back facing relationship to one another upon said base, said lower end of said upright standard being disposed between and attached to said U-shaped balancing members.

11. The apparatus of claim 10 wherein said base is a flat plate.

12. The apparatus of claim 1 wherein each of said members on said second of said opposite ends of said arms is a pedal for receiving a user's foot or hand.

13. A desk chair attachable exercise apparatus, comprising:

(a) a support frame having a lower portion mountable under a chair to hold said support frame in a stationary position with a user seated on the chair, said support frame also having an upper portion spaced above said lower portion, said upper portion being an upright standard having opposite upper and lower ends, said lower portion including a pair of generally U-shaped balancing members mounted in back-to-back facing relationship to one another with said lower end of said upright standard being disposed between and attached to said U-shaped balancing members and a flat base mountable upon a support surface and disposed below and mounted to undersides of said balancing members and extending outwardly in one direction from said upright standard for receiving thereon the chair and together with said U-shaped balancing members providing a means for capturing the chair so as to hold the chair in place to prevent backward movement thereon during use of the apparatus;

(b) an elongated shaft mounted to said upper portion of said support frame and having a pair of opposite end portions extending from opposite sides of said upper portion of said support frame;

(c) a pair of elongated arms each having a pair of opposite ends and being disposed on opposite sides of said upper portion of said support frame, each of said arms at a first of said opposite ends thereof mounted to one of said opposite end portions of said shaft for rotatably mounting each arm to said upper portion of said support frame;

(d) a pair of members each mounted to a second of said opposite ends of a respective one of said arms for engagement by a user to create a force necessary to rotate said arms relative to said upper portion of said support frame; and (e) a resistance generating and adjusting mechanism disposed on said opposite end portions of said shaft at said opposite sides of said upright standard and engaged with said first of said opposite ends of said arms and being operable to generate and selectively adjust a level of resistance to rotation of said arms relative to said upright standard in response to rotation of said arms, said resistance generation and adjusting mechanism including:

(i) a pair of first friction discs, each of said first friction discs having opposite first and second sides and being mounted to a respective one of said opposite end portions of said shaft such that said first sides of said first friction discs contact said opposite sides of said upright standard and said second sides of said first friction discs contact said first ends of said arms;

(ii) a pair of second friction discs, each of said second friction discs having opposite first and second sides and being mounted to a respective one of said opposite end portions of said shaft such that said first sides of said second friction discs contact said first ends of said arms on sides thereof opposite from said first friction discs and said second side of one of said second friction discs contacts said enlarged end element on said shaft;

(iii) a spring element mounted to one of the opposite end portions of the shaft and contacting the second side of the other of said second friction discs, said spring element being compressible for increasing the resistance to rotation of said arms and being expandable for decreasing the resistance to rotation of said arms; and (iv) a knob rotatably mounted on an end of said shaft and contacting said spring element, said knob being rotatable in one direction relative to said shaft for causing compression of said spring element and being rotatable in an opposite direction relative to said shaft for allowing expansion of said spring element.

14. The apparatus of claim 13 wherein said second sides of said first friction discs have recesses formed therein receiving said first ends of said arms so as to prevent rotation of said arms relative to said first friction discs.

15. The apparatus of claim 13 wherein said arms are made of a first material and said first and second friction discs are made of a second material more pliable than said first material of said arms so as to minimize wear on said arms.

16. The apparatus of claim 13 wherein said resistance adjusting means also includes an anti-rotation pin assembly comprising:

a mounting bracket attached to said upper end of said upright standard on an edge thereof extending between said opposite sides thereof, said mounting bracket defining a slot extending between said opposite sides of said upright standard, said second friction discs having respective holes defined therethrough and alignable with one another and with said slot of said mounting bracket; and a pin inserted through said aligned holes of said second friction discs and said slot of said mounting bracket so as to prevent rotational movement of said second friction discs relative to said arms.

17. The apparatus of claim 13 wherein said spring element includes at least one annular conical-shaped washer made of resilient material and deformable from a normal conical shape to a more flattened shape upon application of an axially directed force thereto, said washer being received over said one of said opposite end portions of said shaft.

18. The apparatus of claim 13 wherein each of said members on said second of said opposite ends of said arms is a pedal for receiving a user's foot or hand.

* * * * *